United States Patent [19]

Barnett

[11] 4,116,116

[45] Sep. 26, 1978

[54] METHOD OF MAKING A HEAT SHRINKABLE BAG

[75] Inventor: Karl F. Barnett, Bloomfield Hills, Mich.

[73] Assignee: Cadillac Products, Inc., Sterling Heights, Mich.

[21] Appl. No.: 771,910

[22] Filed: Feb. 25, 1977

Related U.S. Application Data

[60] Division of Ser. No. 594,807, Jul. 10, 1975, Pat. No. 4,022,321, which is a continuation-in-part of Ser. No. 408,308, Oct. 23, 1973, abandoned.

[51] Int. Cl.[2] ..... B31B 1/64

[52] U.S. Cl. ..... 93/35 R; 53/463; 93/DIG. 1

[58] Field of Search ..... 53/184 S, 33, 373, DIG. 2; 93/35 R, 355 SB, 19, 20, 33 H, DIG. 1; 156/583

[56] References Cited

U.S. PATENT DOCUMENTS

| | | | |
|---|---|---|---|
| 2,545,243 | 3/1951 | Rumsey, Jr. | 229/48 T |
| 3,397,505 | 8/1968 | Critchell | 93/DIG. 1 |
| 3,534,666 | 10/1970 | Maccherone | 93/35 SB |
| 3,852,937 | 12/1974 | Bitsura et al. | 53/184 S X |

*Primary Examiner*—James F. Coan

*Attorney, Agent, or Firm*—Harness, Dickey & Pierce

[57] ABSTRACT

A preformed bag-like enclosure formed of heat shrink plastic film for shrink wrapping pallet loads or the like, the enclosure being generally tubular or sleeve-like in shape and provided with a reduced size opening at the top to prevent the enclosure from slipping down over the load to be wrapped prior to the application of heat for shrinking. In one embodiment the top opening is reduced in size by tapering same using upwardly and inwardly extending heat seals, in another by providing transversely extending heat seals and in further ones by providing inwardly spaced spot welds. Methods of fabrication of the latter type are also disclosed.

1 Claim, 11 Drawing Figures

FIG. 4.
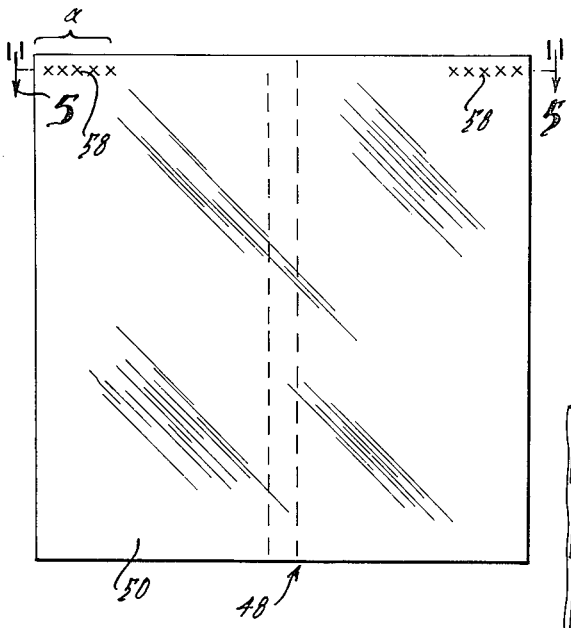
FIG. 5.
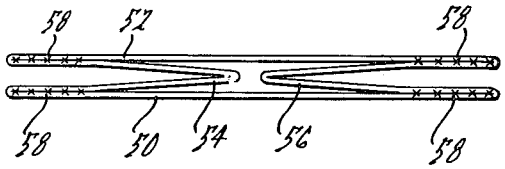
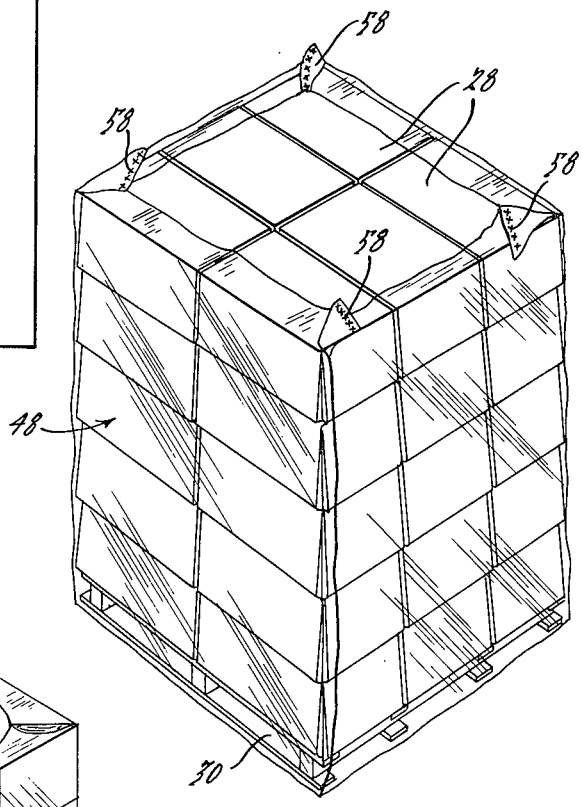
FIG. 6.
FIG. 7.
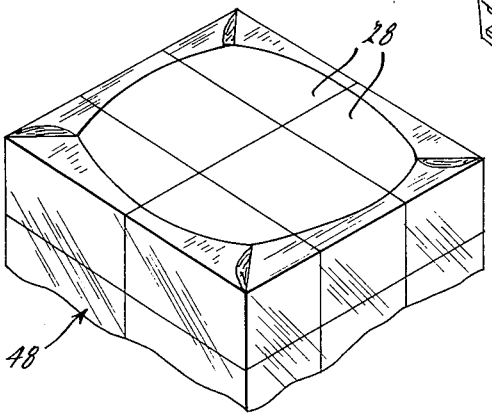
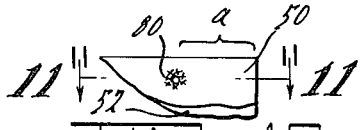
FIG. 10.
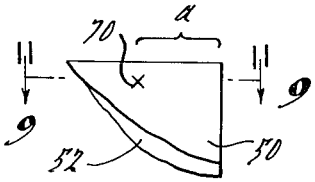
FIG. 8.
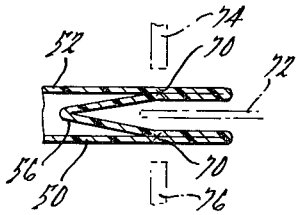
FIG. 9.
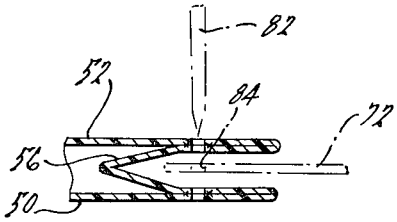
FIG. 11.

METHOD OF MAKING A HEAT SHRINKABLE BAG

CROSS REFERENCE TO RELATED APPLICATION

This is a division of application Ser. No. 594,807, filed July 10, 1975 now U.S. Pat. No. 4,022,321 which is a continuation-in-part application of application Ser. No. 408,308 filed on Oct. 23, 1973, now abandoned, entitled Heat Shrinkable Bag.

BACKGROUND AND SUMMARY OF THE INVENTION

Conventional shrink wraps for covering pallet loads or the like are generally one of two types. One has the configuration of a conventional gussetted bag which is inverted and placed over a load and then run through a heating tunnel or the like to shrink the bag around the load. The other is generally in the form of a sleeve which is formed around the load and then run through a heating tunnel or the like. The latter type has the advantage over the bag type that it requires much less wrap material, however it suffers the disadvantage that it requires the use of relatively complex and expensive machinery for wrapping the film around the load and then seaming it into a sleeve, and the further disadvantage that the resultant sleeve often slides down around the load below the top thereof prior to the application of the heat necessary to hold it in place.

It is therefore a primary object of the present invention to provide several embodiments of an improved preformed shrink wrap each of which obviates the need for expensive wrapping machinery required with sleeve wraps and yet provides the economy resulting from the use of a minimum amount of wrapping material, and which further does not suffer the disadvantage of sleeve type wraps insofar as they are subject to slipping down around the load prior to the application of heat.

Another object of the present invention resides in the provision of several embodiments of a shrink wrap each of which has an open top so that compressible loads can be wrapped in a compressed state.

A further object of the present invention resides in the provision of several embodiments of an improved shrink wrap of the sleeve type each of which comprises means for preventing the wrap from slipping down around the load prior to application of the heat to shrink it into place. A related object concerns the provision of such wraps of both the flat sleeve type and the gussetted sleeve type.

Another object of the present invention resides in the provision of several improved preformed shrink wraps having the advantage of sleeve type wraps with respect to higher moisture vapor transfer rates, better fire rating, and the like.

Another further object of the present invention concerns the provision of a flat sleeve type preformed shrink wrap which is believed to have side seams of increased strength.

Another object of this invention concerns the provision of a gussetted sleeve type preformed shrink wrap which opens square so that it can be applied to a pallet load using a standard automatic bag machine, and yet one in which each corner is provided with means for preventing the wrap from slipping down around the load prior to shrinking.

A further object of the present invention resides in the provision of an extremely simple improved method for making gussetted sleeve-type preformed shrink wraps.

These and other objects of the invention will become apparent from the following description and the appended claims, taken in conjunction with the accompanying drawings.

BRIEF DESCRIPTION OF THE DRAWINGS

FIG. 4 is a plan view of a second embodiment of a preformed shrink wrap embodying the principles of the present invention shown in a collapsed, relatively flat condition;

FIG. 5 is a transverse sectional view taken along line 5—5 in FIG. 4;

FIG. 6 is a perspective view illustrating the wrap of FIG. 4 after it is placed over a pallet load of goods and prior to the application of heat;

FIG. 7 is a partial perspective view of the wrapped pallet load of FIG. 6 after the application of heat to shrink the wrap in place;

FIG. 8 is a partial plan view similar to FIG. 4 but illustrating a further embodiment of the present invention;

FIG. 9 is a transverse sectional view taken along the line 9—9 in FIG. 8 and also illustrating a means of fabrication;

FIG. 10 is a partial plan view similar to FIG. 4 but illustrating yet a further embodiment of the present invention; and FIG. 11 is a transverse sectional view taken along line 11—11 in FIG. 10 and also showing a means of fabrication.

DETAILED DESCRIPTION OF THE PREFERRED EMBODIMENTS

Figure 1:
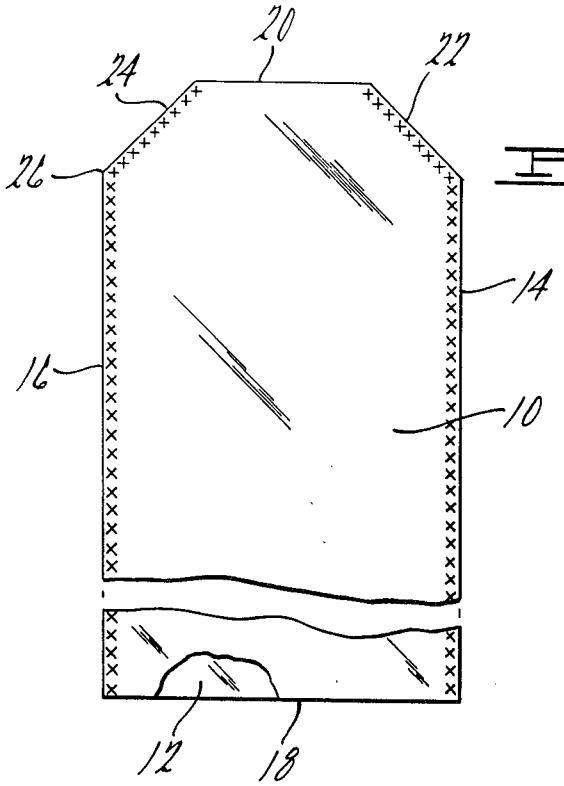
FIG. 1 is a plan view of a first embodiment of a preformed shrink wrap embodying the principles of the present invention shown in a collapsed, relatively flat condition.

The first embodiment of the preformed shrink bag or wrap of the present invention generally comprises, in its collapsed state, two relatively flat sheets 10 and 12 of plastic heat shrink film disposed in a face-to-face relationship. The sheets are of substantially the same shape, having generally parallel joined side edges, either integral with one another or heat sealed together, as at 14 and 16, and generally perpendicular bottom edges 18 which are not connected to one another. This construction is referred to herein as a "flat sleeve type" wrap. The top edge of the wrap preferably has a generally transverse portion 20 and tapered or chamfered end portions 22 and 24 which are integral with one another or heat sealed together. Portion 20 is unsealed and open. The film of which the wrap is fabricated is of any conventional heat shrink (i.e. heat shrinkable) type, the particular material being selected in accordance with known criteria. For example, polyethylene has been found to give very satisfactory results. The gauge of the material used is chosen in accordance with conventional criteria commonly utilized by those skilled in the art, and the film preferably has its machine direction extending generally horizontally as the wrap is shown in FIG. 1 in order to maximize shrink in that direction.

Figure 2:
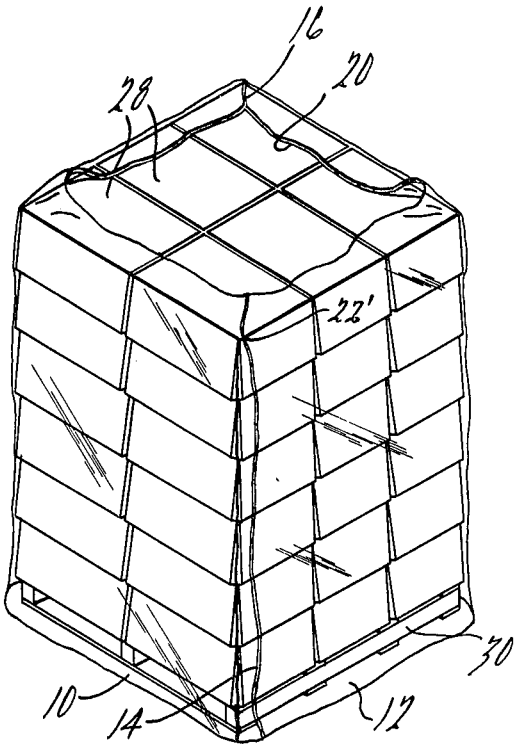
FIG. 2 is a perspective view illustrating the wrap of FIG. 1 after it is placed over a pallet load of goods and prior to the application of heat.

The heat shrink wrap is applied to a stacked load of containers 28 on a pallet 30 by slipping the preformed wrap over the top of the load and permitting it to slide downwardly until the top of the load engages chamfered portions 22 and 24, as best illustrated in FIG. 2. The wrap should thus be sufficiently long that the length thereof from the bottom edge to the intersection of the side edges and chamfered portions, indicated at 26, will extend from the top of the load to below the bottom thereof around the side of the pallet after it has been fully shrunk. As can be seen, opposite side edges 14 and 16 on the collapsed wrap are preferably disposed at or adjacent to the diametrically opposed corners of the load, and the width of the collapsed wrap is chosen to give the wrap sufficient girth or circumference to loosely fit over the load and yet still be capable of being shrunk tightly thereabout.

Chamfered portions 22 and 24 should be of sufficient extent to reduce the upper open end of the wrap to a size which is smaller than the top of the load. This serves the important purpose of preventing the wrap from sliding down over the load subsequent to installation and prior to heating. If desired only one chamfered portion may be provided, with the other end of the top edge forming a conventional square corner with its adjacent side edge, so long as the total top opening of the wrap is smaller than the top of the load. If chamfered portions 22 and 24 are formed at approximately 45° the resultant wrap will lie substantially flat on the top of the load at the opposed corners thereof where side edges 14 and 16 are disposed; however, such is not critical and other angles may be used, so long as the top opening is small enough to prevent the wrap from slipping too far downwardly.

Figure 3:
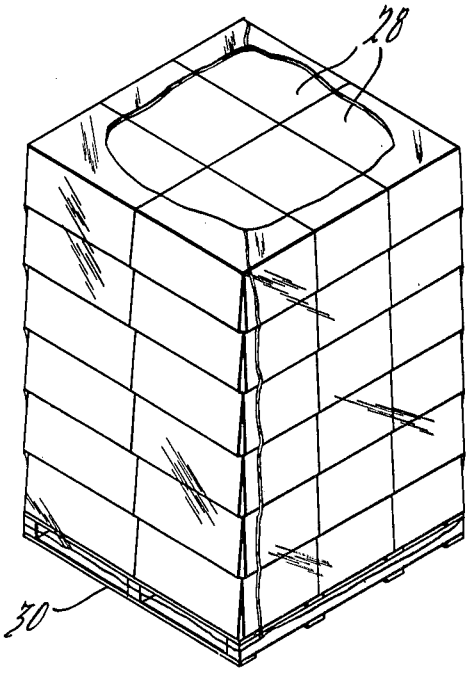
FIG. 3 is a perspective view of the wrapped pallet load of FIG. 2 after the application of heat to shrink the wrap in place.

The draped load is thereafter subjected to heat in the conventional manner, such as being conveyed through a heating tunnel, to shrink the film tightly about the load, as shown in FIG. 3. As can be seen, the wrap will tightly hold all of the articles constituting the load on the pallet, thereby facilitating transportation thereof.

Although the principle is not fully understood, it is believed that the location of side edges 14 and 16 at the diametrically opposed corners of the load (as distinguished from at the sides of the load) results in stronger side seams after shrinking. This may be because there is less tension on the seam at the corners, or because the film at the side edges of the wrap tends to stick to itself when shrunk, or because maximum shrinkage occurs at the sides away from the edges, or a combination thereof.

The second embodiment of the present invention, illustrated in FIGS. 4–7 is a "gussetted sleeve type" preformed shrink wrap 48 comprising in its collapsed state two relatively flat sheets 50 and 52 of plastic heat shrink film disposed in face-to-face relationship. These sheets comprise opposed front panels of the wrap. They are of substantially the same shape and are joined by integrally formed, folded or gussetted side panels 54 and 56, in the conventional manner. The top and bottom of the wrap is formed generally square or perpendicular to the sides thereof and are open so that when the wrap is expanded it constitutes a sleeve-like enclosure.

Adjacent each upper corner of the wrap is provided a relatively short transversely extending heat seal 58 which extends from the outer edge or corner of the wrap inwardly for a distance *a*, as indicated in FIG. 4. This sleeve is made in the conventional manner, such as by a blown film extruder, and seals 58 are located as close to the top of each sleeve as is feasible for the type of equipment being used. The film used is the same as that described above in connection with the first embodiment, except that in gussetted sleeves the film usually has its machine direction extending generally vertically, as shown, as distinguished from transversely as in the previous embodiment.

Wrap 48 is applied to a stacked load of containers 28 on a pallet 30 by slipping the preformed wrap over the load and permitting it to slide downwardly until the top of the load engages seals 58, as best illustrated in FIG. 6 and in the same manner as with the first embodiment. The wrap should be sufficiently long that the length thereof from the bottom of seals 58 to the bottom edge thereof will extend from the top of the load to below the bottom thereof around the side of the pallet after the film has been fully shrunk. As can be seen, the wrap of this embodiment has four discreet corners arranged to be disposed at the four corners of the load. The width of the front and side panels of the wrap are chosen to give the wrap sufficient girth and the proper configuration to loosely fit over the load, and seals 58 extend inwardly a sufficient distance to effectively reduce the open top thereof to a point that it cannot pass over the top of the load. The wrap should not be so large that it cannot be shrunk tightly against the load when subjected to heat shrinking temperatures, in accordance with known criteria. Wrap 48 thus functions in almost exactly the same manner as the wrap of the first embodiment, except that the top of the sleeve does not have the tapered portions but instead transversely extending portions.

The draped load is thereafter subjected to heat in the conventional manner to tightly shrink the film about the load, as illustrated in part in FIG. 7. Obviously the bottom of the packaged load would appear the same as illustrated in FIG. 3.

The third embodiment of the invention, illustrated in FIG. 8, is identical to the preceding embodiment except that instead of a heat seal 58 extending in a line from the outer edge of each corner, there is merely provided a single heat seal or spot weld 70 in each corner of the wrap. Since it is only the innermost spot or zone of the seal (i.e., the point farthest spaced from the edge or corner of the wrap) which defines the effective size of the upper opening of the wrap, a single seal or weld 70 accomplishes the same result as a transverse seal such as 58. As can be seen by comparing FIGS. 4 and 8, seal or weld 70 is spaced inwardly from the edge of the wrap the same distance as the innermost portion of seal 58, using the same criteria.

In FIG. 9 there is illustrated a method by which the wrap of FIG. 8 may be fabricated. The method comprises placing a separator 72 having upper and lower surfaces formed of a release material, such as Teflon, between the folds in each of the side panels and thereafter applying heat to the top and bottom faces of the wrap by means of suitable heated instruments 74 and 76 which move toward one another to pinch and seal the wrap therebetween. Each instrument has an end configuration of the desired shape of the seal or weld. A pair of such instruments may be provided on each side of the wrap. Separator 72 prevents adjacent welds 70 from fusing to one another and thus preventing opening of the wrap. The method may be accomplished by feeding the wrap longitudinally past a stationary separator and intermittently stopping the feed motion to actuate instruments 74 and 76 toward the wrap to simultaneously form all four seals. If the wrap is formed from a continuous web, one or both ends of the wrap may be severed from the web at the same time the four seals are made.

A fourth embodiment of the invention is illustrated in FIG. 10. This embodiment is identical to that illustrated in FIG. 8 except that the single seal or weld, indicated at 80 in this embodiment, is in the form of an opening the periphery of which constitutes a weld between the adjoining layers of film. The wrap of this embodiment may be manufactured in exactly the same manner as described with respect to the preceding embodiment except that instead of a pair of heated instruments a single hot needle 82 is utilized by driving same through both corner portions of the wrap and through a suitably located hole 84 in separator 72. As can be visualized, the driving of the hot needle through the respective layers will create an aperture with a fused periphery and separator 72 will prevent fusion of the adjacent corners to one another, which would of course prevent opening of the wrap. A hot needle may be provided at each side of the wrap so that all four seals may be made at the same time.

As can thus be seen, the spot or zone where the load engages the seal defining end portion 22 or 24 of the first embodiment, indicated at 22' in FIG. 2, is equivalent in function to the innermost portion of each heat seal 58 in FIG. 4 and to seals 70 and 80 in FIGS. 8 and 10, respectively. Although the embodiments of FIGS. 4–11 may not shrink as well in the transverse direction as the embodiment of FIGS. 1–3, because of the machine direction of the film, they do offer the advantage that they open square, engage all four corners of the load and can be draped on the load using a conventional automatic bagger.

One advantage of the shrink wraps of the present invention resides in the fact that compressible loads, such as paper bags, multiwall bags, and the like, may be compression wrapped. Because the wrap of this invention has an open top, a load compressor may be inserted therethrough to hold the load compressed on the pallet (downward compression only) as heat is applied. The compressor, which may be of any convention design, is then removed and the now-shrunk film will hold the load in a compressed state. This technique minimizes the possibility of the wrap material sticking to the load because the load is not being compressed by the film while the latter is in a molten or semi-viscous state. In addition, the open top of the wrap increases the MVT rate of the package, i.e. it permits the escape of moisture vapor from the load, and may have a slightly higher fire rating than conventional shrink bags since it permits extinguishing materials to get to the load in the event of fire.

Thus, there is disclosed in the above description and in the drawings several embodiments of the invention which fully and effectively accomplish the objects thereof. However, it will be apparent that other variations in the details of constructions and method may be indulged in without departing from the sphere of the invention herein described, or the scope of the appended claims.

What is claimed is:

1. The method of fabricating a shrink wrap, comprising the steps of: forming a gussetted sleeve-like enclosure; positioning a separator between the opposed portions of each of the gussetted sides of said enclosure proximate to an end of said enclosure when the latter is collapsed to prevent said portions from contacting one another; and applying heat to a localized spot on the plies of said enclosure by piercing said enclosure with a heated needle that is adapted to piece the portions of said enclosure on both sides of said separator as well as said separator whereby localized heat seals are formed between said ply proximate to said end of said enclosure, said heat seals being wholly spaced from the side edges of said collapsed enclosure.

* * * * *